United States Patent [19]

Ohno

[11] Patent Number: 4,752,804

[45] Date of Patent: Jun. 21, 1988

[54] MULTICOLORED IMAGE FORMING APPARATUS IN WHICH TONER IMAGES ARE SUCCESSIVELY TRANSFERRED FROM A PLURALITY OF IMAGE BEARING MEMBERS TO A TRANSFER MATERIAL

[75] Inventor: Akio Ohno, Tokyo, Japan

[73] Assignee: Canon Kabushiki Kaisha, Tokyo, Japan

[21] Appl. No.: 903,372

[22] Filed: Sep. 3, 1986

[30] Foreign Application Priority Data

Sep. 10, 1985 [JP] Japan ..... 60-198500

[51] Int. Cl.[4] ..... G03G 15/00

[52] U.S. Cl. ..... 355/3 R; 355/4

[58] Field of Search ..... 355/3 R, 3 DR, 4, 14 R

[56] References Cited

U.S. PATENT DOCUMENTS 4,030,445 6/1977 Takenaga et al. ..... 355/4 X 4,227,795 10/1980 Bobbe et al. ..... 355/4 X 4,367,944 1/1983 Kuru ..... 355/6 X 4,410,264 10/1983 Holzhauser et al. ..... 355/4 X 4,531,828 7/1985 Hoshino ..... 355/4 X

*Primary Examiner*—Peter S. Wong

*Attorney, Agent, or Firm*—Fitzpatrick, Cella, Harper and Scinto

[57] ABSTRACT

A color image forming apparatus is an apparatus in which toner images are successively transferred from a plurality of image bearing members to a transfer material, and which is for ensuring the toner images transferred to the transfer material to be transferred to a predetermined position. In the apparatus, patterns depicted on the surface of the image bearing members are read along with the movement of the image bearing members, and on the basis of the read result, control is effected so that the peripheral speed of the image bearing members is constant.

4 Claims, 5 Drawing Sheets

MULTICOLORED IMAGE FORMING APPARATUS IN WHICH TONER IMAGES ARE SUCCESSIVELY TRANSFERRED FROM A PLURALITY OF IMAGE BEARING MEMBERS TO A TRANSFER MATERIAL

BACKGROUND OF THE INVENTION

1. Field of the Invention

This invention generally relates to a color image forming apparatus, and in particular to a multicolored electrophotographic image forming apparatus in which a plurality of latent image bearing members such as electrophotographic photosensitive members are juxtaposed and these photosensitive members are subjected to the electrophotographic image forming process to obtain developed images of respective colors and the developed images are successively transferred to a transfer material carried and conveyed by conveyor means such as a belt to there-by obtain a colored image. The present invention can be embodied not only in electrophotographic color copying apparatuses but also in various color printers or the like, but herein the present invention will be described in connection with a color electrophotographic copying apparatus. Also, the image bering members, such as those in the present invention, may be endlessly movable image bearing members of any shape such as a belt-like shape or a drum-like shape. For purposes of example, the image bearing members will be described as being of a drum-like shape.

2. Related Background Art

Several types of electrophotographic color copying apparatuses have heretofore been proposed and commercialized. A typical color copying apparatus in which the present invention may be used is illustrated in FIG. 2 of the accompanying drawings.

In the color electrophotographic copying apparatus of FIG. 2, four image forming units Pa, Pb, Pc and Pd are disposed and respectively have exclusive photosensitive drums 1*a*, 1*b*, 1*c* and 1*d*, around which are disposed exposure means 3*a*, 3*b*, 3*c*, 3*d*, developing stations 4*a*, 4*b*, 4*c*, 4*d*, transfer stations 5*a*, 5*b*, 5*c*, 5*d* and cleaning stations 6*a*, 6*b*, 6*c*, 6*d*. On the other hand, conveyor means 7 such as an endless belt is disposed through the image forming units Pa, Pb, Pc and Pd and below the photosensitive drums 1*a*, 1*b*, 1*c* and 1*d* to convey a transfer material 9 fed by paper feed rollers 8 through the transfer stations 5*a*, 5*b*, 5*c* and 5*d* of the image forming units Pa, Pb, Pc and Pd, respectively.

In such a construction, a latent image of a yellow component color corresponding to the image of an original is first formed on the photosensitive drum 1*a* by conventional electrophotographic means such as the charging station 2*a* and exposure means 3*a* of the first image forming unit Pa, whereafter a visible image is formed at the developing station 3*a* by a developer having yellow toner, and at the transfer station 4*a*, the yellow toner image is transferred to the transfer material 9 conveyed thereto by the conveyor means 7.

On the other hand, while the yellow image is being transferred to the transfer material 9, a latent image of magenta component color is formed in the second image forming unit Pb, and subsequently, a toner image by magenta toner is obtained at the developing station 4*b*, and when the transfer material 9 to which the aforementioned yellow toner image has been transferred in the first image forming unit Pa is conveyed to the transfer staiton 5*b* of the second image forming unit Pb, the magenta toner image is transferred to a predetermined location on the transfer material 9.

Thereafter, with respect to each of cyan color and black color, image formation is carried out in a similar manner, and when superposition of four color toner images is completed on the transfer material 9, the transfer material 9 is fixed at a fixing station 10 and thus, a multicolored (full-colored) image is obtained on the transfer material 9.

After the termination of the image transfer, the respective photosensitive drums are cleaned by the cleaning means 6*a*, 6*b*, 6*c* and 6*d* to remove any residual toners therefrom, thus becoming ready for the next cycle of latent image formation.

Such a full-colored image forming apparatus has the merits.

(1) that it is advantageous for high-speed operation because it has respective image forming units for respective colors; and (2) that it has adaptability for a transfer material such as thick paper or the like because the transfer path can be constructed on a straight line.

However, one of the greatest demerits of such apparatus is that it has many problems in accomplishing the registration between images of respective colors formed by different image forming units.

The deviation between the formed positions of the four colored images transferred onto the transfer material (the misregistration) finally appears as color misregistration or a change in hue. To prevent such misregistration, the following countermeasures are necessary:

(1) To adjust the rotational speeds of the four photosensitive drums 1*a*, 1*b*, 1*c* and 1*d* to one another; and (2) To keep the speed of movement of the transfer material constant.

Therefore, in the past, an encoder was directly connected to a drive motor for the photosensitive drums and transfer material conveying means to control the drive motor by PLL control so as to keep constant rotation.

However, if there is an eccentric component in the reduction gear train connected to the drive motor, a speed change will occur to the driven members such as the photosensitive drums. Also, the eccentricity of the photosensitive drums or the eccentric component resulting from the axis deviation between the photosensitive drums and the photosensitive drum driving member will cause a speed change of the surface of the photosensitive drums. Such speed change of the surface of the drums will in turn cause positional deviation of the image writing (for example, image exposure starting) position during the formation of latent images on the photosensitive drums.

The amount of image writing position deviation $\Delta L$ is a period function with one full rotation $2\pi$ of the photosensitive drums as the period and is therefore given as the following equation by Fourier series, and $\Delta L$ varies in the fashion of sine.

$$\begin{aligned}\Delta L(\theta) &= a_0 + a_1\cos\theta + a_2\cos 2\theta + \ldots + a_n\cos N\theta + \\ &\quad b_1\sin\theta + b_2\sin 2\theta + \ldots + b_n\sin N\theta \\ &= a_0 + c_1\cos(\theta + \Psi_1) + c_2\cos(2\theta + \Psi_2) + \ldots + \\ &\quad c_n\cos(N\theta + \Psi_n).\end{aligned} \tag{1}$$

FIG. 3 of the accompanying drawings schematically shows the shape of a photosensitive drum having a radius $\gamma$. The center of the drum is O', the center of rotation is O, and accordingly, the amount eccentricity e is e=(OO'). Arrow X indicates the exposure position to the photosensitive drum by exposure means.

Assuming that image writing-out, i.e., exposure, has been started from a state in which, as shown in FIG. 3, the center of the drum has become eccentric from the center of rotation O to the position of an angle $\Psi$, when the photosensitive drum is further rotated by an angle $\theta$ from this state, the amount of positional deviation $\Delta L$ of the image formed on the drum is such as shown in FIG. 4 of the accompanying drawings.

Irrespective of the magnitude of the angle of deviation $\Psi$ of the center O' of the photosensitive drum from the center of rotation O, the amount of positional deviation $\Delta L$ makes a sine-like change having an amplitude of *2e*, but by the change of the angle $\Psi$ (phase), $\Delta L$ is fast or slow relative to the regular position.

From the above-described simulation, the image formed at $\theta=\pi$ when a drum having an amount of eccentricity e is put out in the apparatus shown in FIG. 2, for example, when an image is written from the time when the yellow drum is at $\Psi=O$ and an image is written from the time when the magenta drum is at $\Psi=\pi$ is slower by *2e* for yellow than the regular position and faster by *2e* for magenta than the regular position and thus, the color misregistration between the two is *4e*.

That is, in the case of a drum having eccentricity of 0.1 mm, color misregistration of maximum 0.4 mm occurs. Such positional deviation between images by eccentricity holds true not only of the eccentricity of the photosensitive drums, but also of the eccentricity caused by the back-lash during the mounting of the photosensitive drums and the eccentricity of the driving gears.

The positional deviation between images caused by eccentricity can be reduced if the absolute amount of eccentricity is made small, but it requires high accuracy of the drums and high accuracy of the drum driving gears, and this poses a problem in cost. Also, the photosensitive drums and gears are incorporated without any special attention being paid thereto when they are mounted into the apparatus body and therefore, it is difficult to control the eccentricity phase angle $\Psi$ of the photosensitive drums. Also, even if the first photosensitive drum is carefully incorporated, the phase angle $\Psi$ differs each time the photosensitive drum is interchanged, and this leads to a problem that color misregistration may occur at a later time.

SUMMARY OF THE INVENTION

It is therefore an object of the present invention to solve the above-noted problems and to provide an image forming apparatus in which any speed change of the surface of latent image bearing members is detected and the phase angles of the speed change periods of the respective image bearing members are made coincident with one another to thereby enable colored images free of color misregistration to be formed.

To achieve the above object, a multicolored image forming apparatus in accordance with the present invention has a plurality of endlessly movable image bearing members, means for forming images with different color toners on said image bearing members, means opposed to said image bearing members and transferring the formed toner images to a transfer material, means for conveying the transfer material to the transfer position of each of said image bearing members, and control means for detecting any change in the peripheral speed of each of said image bearing members and controlling the peripheral speed on the basis of the result of said detection so that phases are coincident with one another.

DESCRIPTION OF THE PREFERRED EMBODIMENT

An embodiment of the image forming apparatus according to the present invention will hereinafter be described with reference to the drawings.

Figure 1:
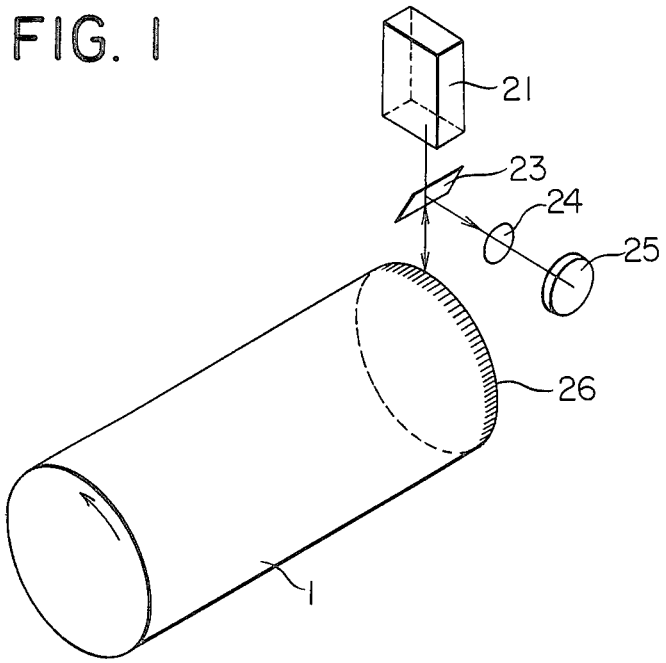
FIG. 1 is a perspective view of the speed change detecting means of a photosensitive drum used in an image forming apparatus according to the present invention.

FIG. 1 shows an embodiment of velocity fluctuation detecting means on a photosensitive drum 1 according to the present invention. In the present embodiment, the velocity fluctuation detecting means comprises a semiconductor laser source 21, a half-mirror 23, an imaging lens 24 and a laser light detector 25. Pit patterns 26 are formed at precisely equal intervals on the circumference of the photosensitive drum 1 at one end thereof, and the laser light from the semiconductor laser source 21 may impinge on the surface of the drum perpendicularly thereto at a exposure station.

Figure 4:
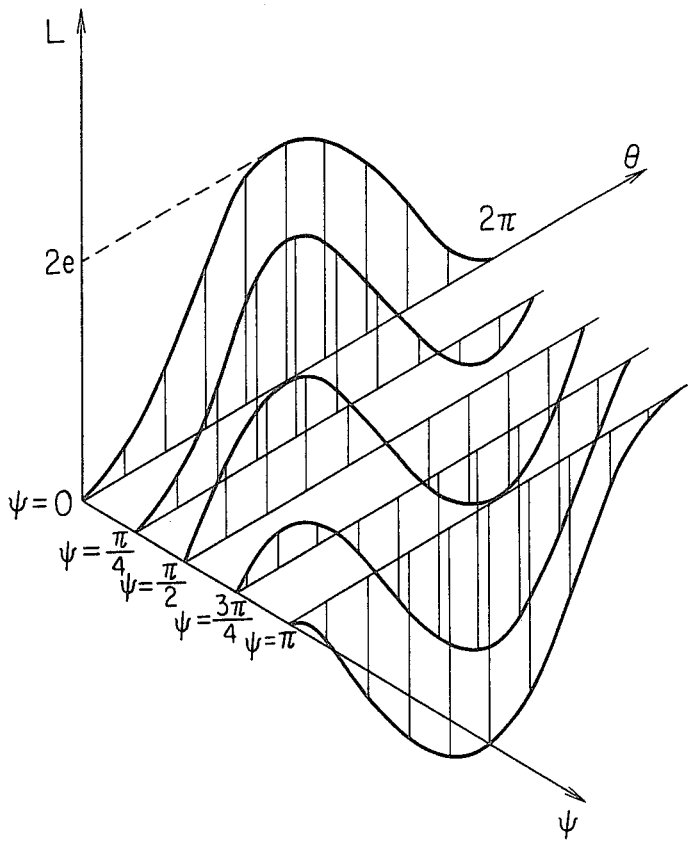
FIG. 4 shows the relation between the phase angles of the photosensitive drums and the positional deviation between the images on the photosensitive drums.

In the above-described construction, the laser light emitted from the semiconductor laser source 21 which is a light source is stopped down with a spot diameter by the imaging lens 24, passes through the half-mirror 23 and is imaged on the pit patterns on the surface of the photosensitive drum. That part of the laser light applied to the portion of the drum surface which is not the pit is reflected and travels toward the half-mirror 23, and is reflected by the half-mirror 23 and enters the detector 25. When it impinges on the portion of the drum surface which is the pit, the laser light is scattered and does not travel toward the half-mirror 23 and does not enter the detector 25. That is, depending on the presence or absence of the pit, high and low pulse signals are produced in the detector 25 with the movement of the photosensitive drum. Here, a case where an eccentric drum having an amount of eccentricity OO′=e between the drum center O′ and the center of rotation O as shown in FIG. 4 is moved at a uniform angular speed w.

It is to be understood that n pits are formed on the photosensitive drum 1 about the center O′ thereof. That is, a pulse consisting of n periods is generated for one full rotation of the photosensitive drum. The photosensitive drum is driven by a drive motor (not shown) which is caused to generate a reference pulse by a rotary encoder. The pulse number of the rotary encoder is converted on the photosensitive drum and is brought into coincidence with n, i.e., the number of the pit patterns on the photosensitive drum. The pulse number of the rotary encoder need not always be brought into coincidence with the number of the pit patterns, but can be an integer times as great as the number of the pit patterns.

In the apparatus shown in FIG. 1, when the pulse period of the reflected light from the pit is detected at X on the photosensitive drum, the angle $a_k$-O-$a_{(k+1)} \neq$ the angle $a_{(k+1)}$-O-$a_{(k+2)}$ and therefore, the time until $a_{(k+1)}$ is detected after the pit $a_k$ has been detected and the time until the pit $a_{(k+2)}$ is detected after the pit $a_{(k+1)}$ has been detected differ from each other.

Figure 6:
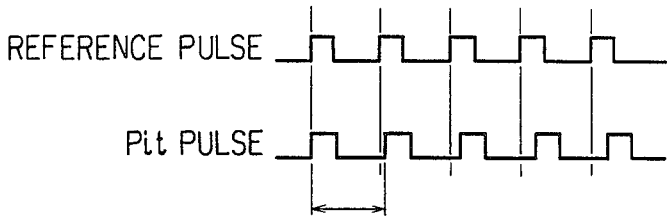
FIG. 6 shows the relation between the pit pulse by the speed change detecting means of the photosensitive drum and a reference pulse.

Accordingly, the pulse train generated by the pit patterns with the pulse train from the encoder directly connected to the motor as a reference signal varies as shown in FIG. 6. That is, the velocity fluctuation of the drum surface by the eccentric component can be detected as a variation in the period of the pit pulse. This fluctuation period of the pit pulse period is represented by the period function with one full rotation ($2\pi$) of the drum as a period, that is, the aforementioned equation (1). Accordingly, if the Fourier series is limited to a finite term, $$S(\theta) = a_0 + a_1\cos\theta + a_2\cos 2\theta + \ldots + a_n\cos N\theta + b_1\sin\theta + b_2\sin 2\theta + \ldots + b_n\sin N\theta \quad (2)$$

and if each constant is calculated by the minimum square method with the pulse period of the kth pit pattern as yk, approximation can be made as follows:

$$\left.\begin{aligned} a_0 &= 1/n \sum_{k=1}^{n} yk \\ a_m &= 2/n \sum_{k=1}^{n} yk\cos M\theta k \\ b_m &= 2/n \sum_{k=1}^{n} yk\sin M\theta k \end{aligned}\right\} \quad (3)$$

Comparing equation (1) with equations (3), the latter can be represented as follows:

$$\left.\begin{aligned} c_m &= \sqrt{a_m 2 + b_m 2} \\ \tan\Psi_m &= -a_m/b_m \end{aligned}\right\} \quad (4)$$

In equation (1), the dominant term of a period $2\pi$ is $C_1 \cos(\theta+\Psi_1)$ and therefore, $\tan \Psi_1 = -a_1/b_1$, and the phase angle $\Psi_1$ of eccentricity can be calculated by the use of equation (3).

Figure 2:
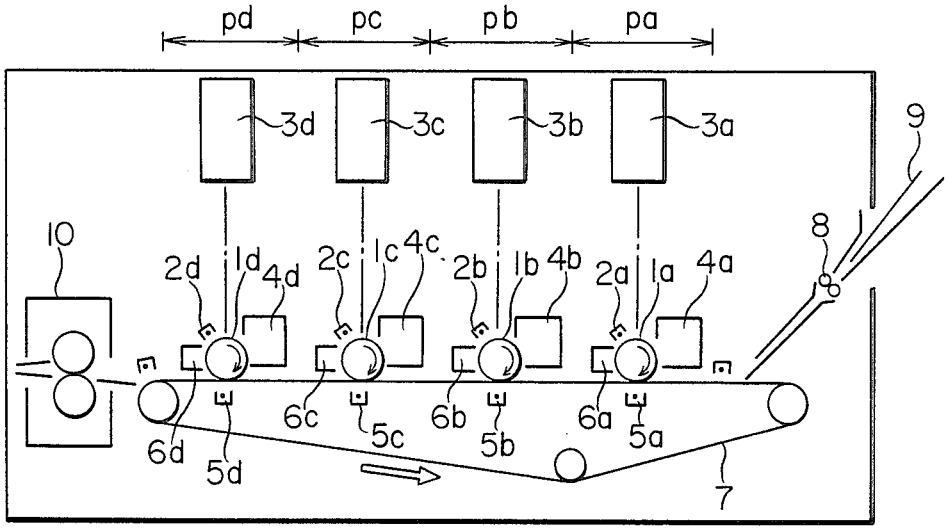
FIG. 2 is a schematic cross-sectional view showing an embodiment of the image forming apparatus to which the present invention is applicable.
Figure 3:
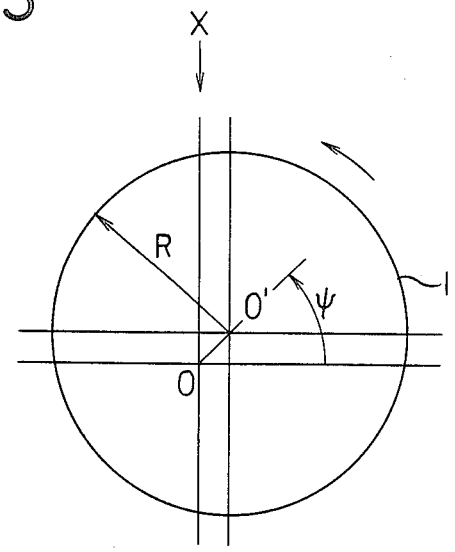
FIG. 3 is a schematic view of a photosensitive drum showing the relation between the amount of eccentricity of the photosensitive drum and the exposure position.

By the above-mentioned calculation, the eccentricity phase angle Ψ on each photosensitive drum can be detected from the pulse train of the pit patterns formed on every photosensitive drum shown in FIG. 2. This phase angle Ψ may be taken in the form of the pulse number from the reference pulse on the photosensitive drum as the angle from a reference point (not shown). For example, a home position sensor capable of detecting one pulse for one full rotation of the drum may be provided on the end surface or peripheral surface of the drum, and if the angle of rotation of the photosensitive drum at the position of the eccentricity phase angle Ψ of every drum is made coincident with the image writing-out position of the photosensitive drum, the amount of color misregistration can be minimized.

Figure 7:
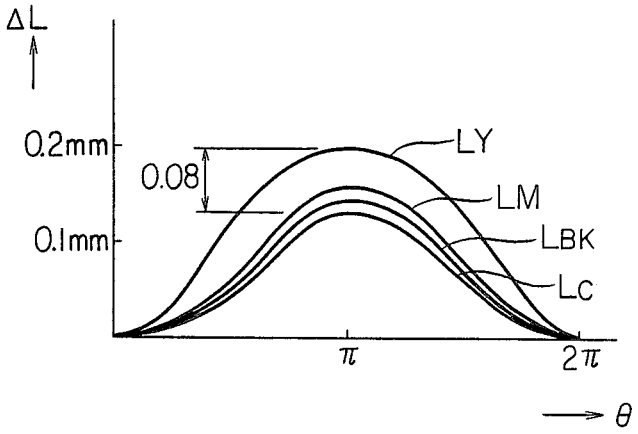
FIG. 7 is a graph showing the relation between the angles of rotation of the photosensitive drums when the amount of eccentricity of each photosensitive drum is set to a particular value and the amount of positional deviation between the images on the photosensitive drums.

For example, where in FIG. 2, the eccentricity of the yellow drum 1*a* is 0.1 mm and the eccentricity of the magenta drum 1*b* is 0.08 mm and the eccentricity of the cyan drum 1*c* is 0.06 mm and the eccentricity of the black drum 1*d* is 0.07 mm, the respective phase angles are made coincident with one another, whereby the amount of image position misregistration ΔL to be written onto the photosensitive drum becomes such as shown in FIG. 7, and the maximum amount of color misregistration is 0.08 mm between the yellow image and the cyan image. When the phase angles Ψ are not coincident with one another, as the worst combination, the amount of image position misregistration ΔL of $2\times(0.1+0.08)=0.36$ mm occurs between the yellow image and the magenta image.

Figure 8:
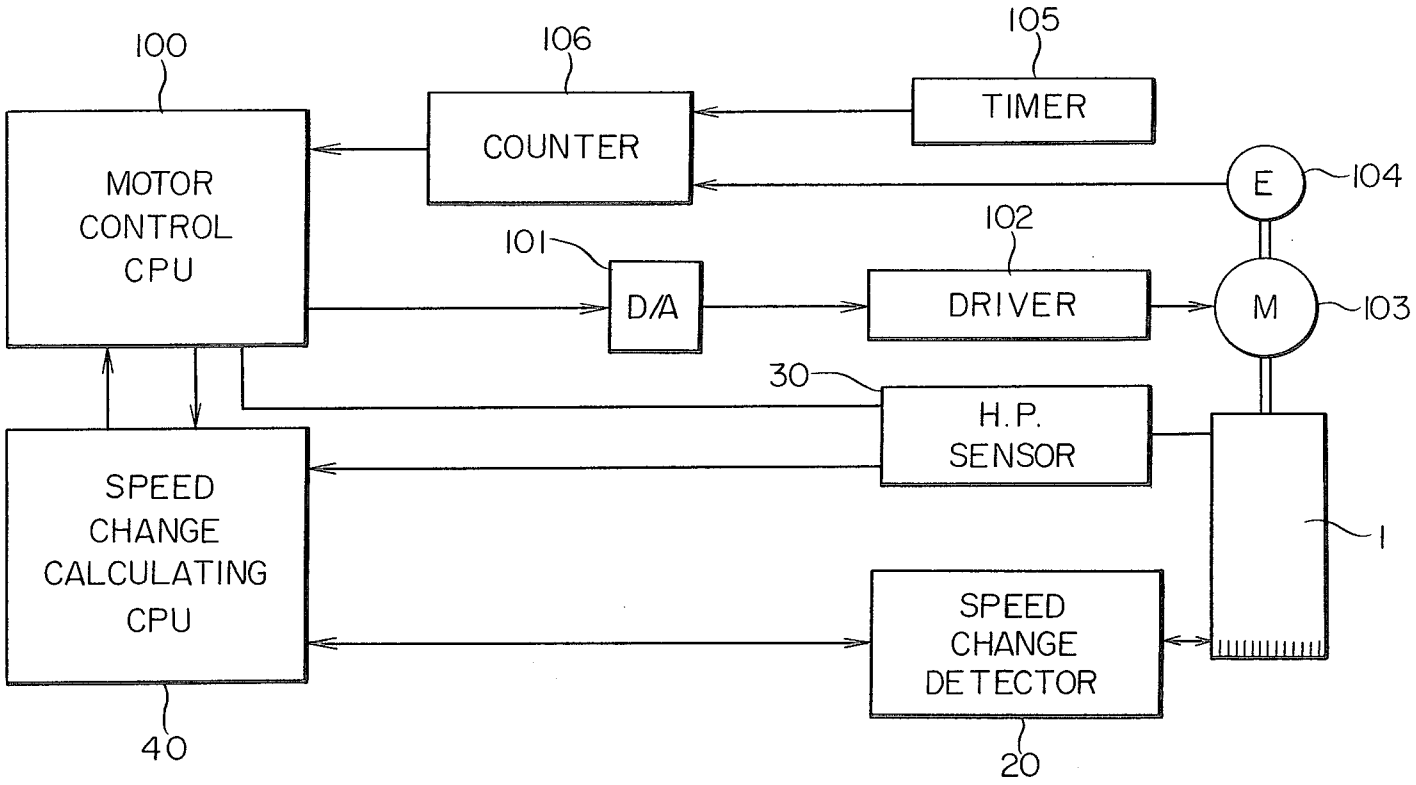
FIG. 8 is a block diagram showing the control mode of the image forming apparatus according to the present invention.

The control mode of the image forming apparatus according to the present invention will now be described with reference to the block diagram of FIG. 8.

First, when the main switch is closed, the four photosensitive drums 1*a*, 1*b*, 1*c* and 1*d* start to be operated at a predetermined constant speed. The control of this constant speed operation is effected in such a manner that the pulse generated from an encoder 104 by the revolution of a motor 103 is counted per predetermined time and a control signal is put out from a driver 102 to the motor 103 through a motor control CPU 100 to a D/A converter 101 so that the revolution of the motor is made coincident with a predetermined pulse number.

When a reference position signal is obtained from a home position sensor 30 during the rotation of the photosensitive drums, the pulse train obtained from the speed detector which measures the revolved position of the motor by the encoder 104 and the change of the speed of the drums by a speed detector 20 shown in FIG. 1 effects the aforedescribed calculation by a speed change calculating CPU and calculates the eccentricity phase angle Ψ. This eccentricity phase angle Ψ corresponds to the pulse number of the encoder 104 counted from the reference signal obtained from the home position sensor 30. The above-described operation is performed with respect to each of the yellow, magenta, cyan and black photosensitive drums, whereby the eccentricity phase angle Ψ of each drum is found. Although description has been made of an example in which the change of the speed of each drum is analyzed from the Fourier series and thereby the eccentricity phase angle is found, a system is also possible in which, as the simplification of the detection, at what pulse from the drum reference signal the maximum value or the minimum value of one period yk of the pit pulse of FIG. 6 is produced is measured and the maximum points or the minimum points are made coincident with one another.

The image forming apparatus according to the present invention which is constructed as described above has the following effects:

(1) The speed change on the photosensitive drum including every speed change component in the drive transmitting path from the drive motor to the latent image bearing member, for example, the photosensitive drum, can be detected.

(2) The color misregistration can be minimized by adjusting the phase of the photosensitive drum having an eccentric component.

(3) Even when the photosensitive drum is interchanged, the apparatus operates in the same manner as before the interchange of the drum and the adverse effect of the interchange of the drum is avoided. That is, there is the interchangeability of the drum.

(4) The element like a random variable called the phase which is a parameter of color misregistration can be eliminated and the amount of color misregistration can be evaluated at an absolute value.

In the present embodiment, an encoder is used to make a reference pulse, but alternatively, a stepping motor or an internal timer may be used.

I claim:

1. A multicolored image forming apparatus having:

a plurality of endlessly movable image bearing members:

means for forming images with different color toners on said image bearing members;

means opposed to said image bearing members and transferring the formed toner images to a transfer material;

means for conveying the transfer material to the transfer position of each of said image bearing members; and means for detecting a change in a peripheral speed of each of said image bering members and causing phases of the changes in the peripheral speeds of the image bearing members to coincide with each other on the basis of the detection.

2. A multicolored image forming apparatus according to claim 1, wherein said detecting and coinciding means has means for producing a speed change signal based on the peripheral speed of each of said image bearing members.

3. A muticolored image forming apparatus according to claim 2, wherein said means for producing the speed change signal has patterns depicted at predetermined intervals on the surface of each of said image bearing members, and means for reading said patterns.

4. A muticolored image forming apparatus according to claim 3, wherein said detecting and coinciding means detects an eccentricity phase angle during rotation of said image bearing members from a sine variation in a pulse pitch generated from patterns with a reference point relative to said patterns provided on said image bearing members as a starting point and operates so that respective image writing positions for the respective image bearing members are of the same angle relative to said eccentricity phase angle, thereby effecting image formation.

* * * * *

UNITED STATES PATENT AND TRADEMARK OFFICE

CERTIFICATE OF CORRECTION

PATENT NO. : 4,752,804

DATED : June 21, 1988

INVENTOR(S) : Akio Ohno

It is certified that error appears in the above-identified patent and that said Letters Patent is hereby corrected as shown below:

COLUMN 1

Line 20, "there-by" should read --thereby--.
Line 26, "bering" should read --bearing--.
Line 57, "developing station 3a" should read --developing station 4a--.
Line 58, "transfer station 4a," should read --transfer station 5a,--.

COLUMN 2

Line 1, "staiton" should read --station--.
Line 17, "merits." should read --merits:--.

COLUMN 3

Line 3, "radius $\gamma$ ." should read "radius R.--.
Line 4, "amount eccentricity" should read --amount of eccentricity--.
Line 35, "back-lash" should read --backlash--.

COLUMN 4

Line 56, "a" should read --an--.
Line 61, "pit patterns" should read --pit patterns 26--.

UNITED STATES PATENT AND TRADEMARK OFFICE

CERTIFICATE OF CORRECTION

PATENT NO. : 4,752,804

DATED : June 21, 1988

INVENTOR(S) : Akio Ohno

It is certified that error appears in the above-identified patent and that said Letters Patent is hereby corrected as shown below:

COLUMN 5

Figure 5:
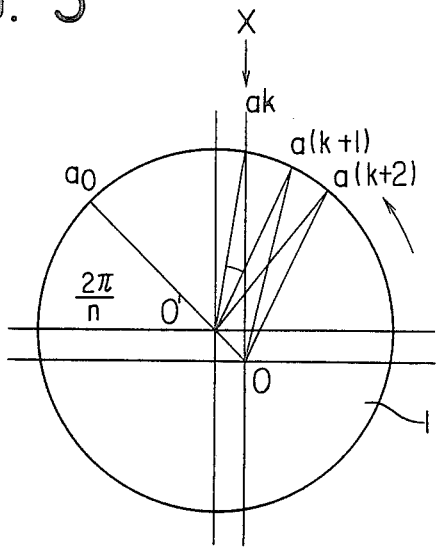
FIG. 5 is a schematic view of a photosensitive drum showing the relation between the amount of eccentricity and phase angle of the photosensitive drum and the exposure position.

Line 7, "speed w." should read --speed.--.
Line 22-4, after "FIG.1" insert --with reference to FIG. 5--.
Line 25, "$a_{(k+1)-0-a(k+2)}$" should read --$a_{(k+1)-0-a(k+2)}$--.

COLUMN 7

Line 30, "bers:" should read --bers;--.

COLUMN 8

Line 8, "bering" should read --bearing--.
Line 17, "muticolored" should read --multicolored--.
Line 22, "muticolored" should read --multicolored--.

Signed and Sealed this

Twenty-first Day of March, 1989

*Attest:*

DONALD J. QUIGG

*Attesting Officer*

*Commissioner of Patents and Trademarks*